United States Patent [19]

Zansky

[11] Patent Number: 4,523,131

[45] Date of Patent: Jun. 11, 1985

[54] DIMMABLE ELECTRONIC GAS DISCHARGE LAMP BALLAST

[75] Inventor: Zoltan Zansky, Roseville, Minn.

[73] Assignee: Honeywell Inc., Minneapolis, Minn.

[21] Appl. No.: 448,539

[22] Filed: Dec. 10, 1982

[51] Int. Cl.[3] ..... G05F 1/00; H05B 37/02; H05B 39/04; H05B 41/36

[52] U.S. Cl. ..... 315/307; 315/247; 315/219; 315/225; 315/206; 315/308; 315/DIG. 4; 315/DIG. 7; 363/41; 363/46

[58] Field of Search ..... 315/DIG. 5, DIG. 7, 315/DIG. 2, 206, 219, 307, 308, 291, 247, 244, 225, DIG. 4; 363/39, 40, 41, 44, 45, 46

[56] References Cited

U.S. PATENT DOCUMENTS

| | | | |
|---|---|---|---|
| 3,890,537 | 6/1975 | Park et al. | 315/247 |
| 3,896,336 | 7/1975 | Schreiner et al. | 315/DIG. 7 |
| 3,969,652 | 7/1976 | Herzog | 315/308 |
| 3,999,100 | 12/1976 | Dendy et al. | 315/291 |
| 4,240,009 | 12/1980 | Paul | 315/DIG. 5 |
| 4,251,752 | 2/1981 | Stolz | 315/206 |
| 4,277,728 | 7/1981 | Stevens | 315/DIG. 5 |
| 4,346,332 | 8/1982 | Walden | 315/307 |
| 4,388,563 | 6/1983 | Hyltin | 315/209 R |
| 4,392,087 | 7/1983 | Zansky | 315/106 |
| 4,415,839 | 11/1983 | Lesea | 315/308 |

OTHER PUBLICATIONS

Gunther, Martin, "Neuerungen beim Zubehor fur Lichtquellen: Elektronische Vorschaltgerate im Kommen" Licht, Jul. 8, 1981, (pp. 414–417) with translation.

Kobayashi, Hisao, et al., "Electronic Energy-Saving Ballast, Superballast" Toshiba Review No. 127, May--Jun. 1980, pp. 37–41.

*Primary Examiner*—Saxfield Chatmon

*Attorney, Agent, or Firm*—Charles G. Mersereau

[57] ABSTRACT

A two-wire electronic dimming ballast arrangement for one or more gas discharge lamps is disclosed which includes an inverter driven by a variable pulse width electric power and a control system for modulating the pulse width of the variable pulse width square wave electric power driving the inverter. A unique distortion suppression system is provided for suppressing current abberations and achieving substantially a unity power factor.

13 Claims, 4 Drawing Figures

DIMMABLE ELECTRONIC GAS DISCHARGE LAMP BALLAST

CROSS REFERENCE TO CO-PENDING APPLICATIONS

Cross-reference is made to a related application of Thomas A. Stamm and Zoltan Zansky, the inventor in the present application, Ser. No. 448,538, entitled "Remote Control of Electronic Dimming Ballasts for Fluorescent Lamps", filed of even date and assigned to the same assignee as the present application. That application concerns a high frequency electronic dimming ballast capable of remote control by means of a power-line carrier or other signalling system which may be computer controlled. The present invention relates generally to a two-wire, high frequency dimmable electronic ballast for powering gas discharge lamps which achieves substantially a unity power factor and greatly reduces power supply current harmonics in a simplified, low-cost manner. The ballast is readily adaptable to remote control and may be used in conjunction with the control system of the cross-referenced application.

BACKGROUND OF THE INVENTION

1. Field of the Invention

The present invention relates generally to the field of two-wire, high frequency electronic ballasts for powering gas discharge lamps and the like and, more particularly, to a two-wire electronic ballast arrangement which achieves a unity power factor and greatly reduces power supply current harmonics in a simplified, low-cost manner.

2. Description of the Prior Art

Typical fluorescent lamps comprise a sealed cylinder of glass having a heating filament at either end and filled with a gas such as mercury vapor. The supplied voltage is utilized to heat the filaments to a point where a thermoionic emission occurs such that an arc can be struck across the tube causing the gas to radiate. Initial radiation given off by gases such as mercury vapor is of a short wavelength principally in the ultraviolet end of the spectrum and thus little visible light is produced. In order to overcome this problem, the inside of the tube is coated with a suitable phosphor which is activated by the ultraviolet radiation and, in turn, emits visible light of a color that is characteristic of the particular phosphor or mixture of phosphor employed to coat the tube.

Solid-state ballasts must provide the same primary function as the conventional core-coil ballasts well known in the art, i.e., they must start and operate the lamp safely. Solid-state ballasts normally convert conventional 60 Hz AC to DC and then invert the DC to drive the lamps at a much higher frequency. That frequency generally is in the 10 to 50 KHz range. It has been found that fluorescent lamps which are operated at these higher frequencies have a higher energy efficiency than those operated at 60 Hz, and they exhibit lower power losses. In addition, at high frequencies, annoying 60 cycle "flickering" and ballast hum are eliminated.

An important consideration in the operation of dimming ballast lamps is concerned with the fact that in order to sustain the arc across the lamps, the filament voltage must be maintained to a predetermined level. The maintenance of this predetermined voltage level in a low-cost scheme for dimming the output of the fluorescent tubes in a solid-state ballast system to produce an energy-saving, light-dimming arrangement has long been a problem in the art. One prior solution to this problem is illustrated and described in a co-pending application of Zoltan Zansky, the inventor in the present application, Ser. No. 210,650, filed Nov. 26, 1980, now U.S. Pat. No. 4,392,087 and assigned to the same assignee as the present application.

In the prior art the main power supply for solid-state ballasts has usually consisted of line current rectified by a rectifier bridge and filtered by inductive and/or capacitive means. One of the greatest problems associated with such a system concerns distortion in the rectified main power supply current which results in heavy contamination of the main power supply current with third, fifth or higher harmonics. This produces an inefficient power factor, shorter lamp life and may also result in overheating of the neutral wire of the building wiring which produces inefficiencies including power losses in the building transformer and other parts of the distribution power network. Such harmonics have been eliminated in the prior art by the use of a second stage converter or by using a large filtering inductor/capacitor circuit in the system. This, however, is quite expensive and still results in a considerable amount of power loss in the ballast circuit.

One example of such a prior art approach to the problem is illustrated and described in an article by Martin Gunther entitled, "Innovations for the Accessories for Light Sources: the electronic ballasts are coming" (title translated from the German), Licht, (pp. 414–416) 7-8/81. That reference depicts a solid-state ballast circuit in which a second stage converter is added ahead of the filter capacitor. This converter is a "boost-type" or a "flyback" converter, which has the characteristic of drawing pure sinusoidal current from the main power supply and in this manner eliminating the harmonic and associated power factor problems. While this prior art approach is effective in reducing harmonic distortion, the addition of the second converter stage increases the cost of the solid-state ballast substantially, and increases the system power loss and circuit heat generation.

SUMMARY OF THE INVENTION

By means of the present invention, the problems associated with greatly reducing the main power supply current harmonics and achieving substantially a unity power factor have been achieved in a solid-state dimmable ballast at a reduction in cost. The need to use large filtering inductor/capacitor components has been eliminated by the provision of a sinusoidal main power supply current synthesizing system which utilizes feedback together with a control logic adapted to produce efficient operation at a significant reduction in cost.

The preferred embodiment utilizes full wave rectifier and a half-bridge inverter driven by a high frequency variable pulse width modulated voltage such as from a switch mode power supply (SMPS). The width of the pulse is controlled by the SMPS by means of an error signal based on a comparison of two signals. An inverted, amplified signal proportional to the unfiltered double wave rectified main supply voltage is continuously compared to an amplified signal proportional to the instantaneous value of the rectified input line current. The SMPS adjusts the input to the inverter so that the voltage and current are coincident thereby eliminating harmonics and achieving a unity power factor.

Dimming may be achieved by providing a variable gain to the amplified input signal proportional to the input voltage and modulating the gain of that amplifier which, in turn, modulates the PWM supply through the SMPS. In the preferred embodiment provision is made for adjusting the lamp output and starting and stopping the lamp by remote, external means.

BRIEF DESCRIPTION OF THE DRAWINGS

In the drawings wherein like numerals are utilized to denote like parts throughout the same.

DESCRIPTION OF THE PREFERRED EMBODIMENT

Figure 1:
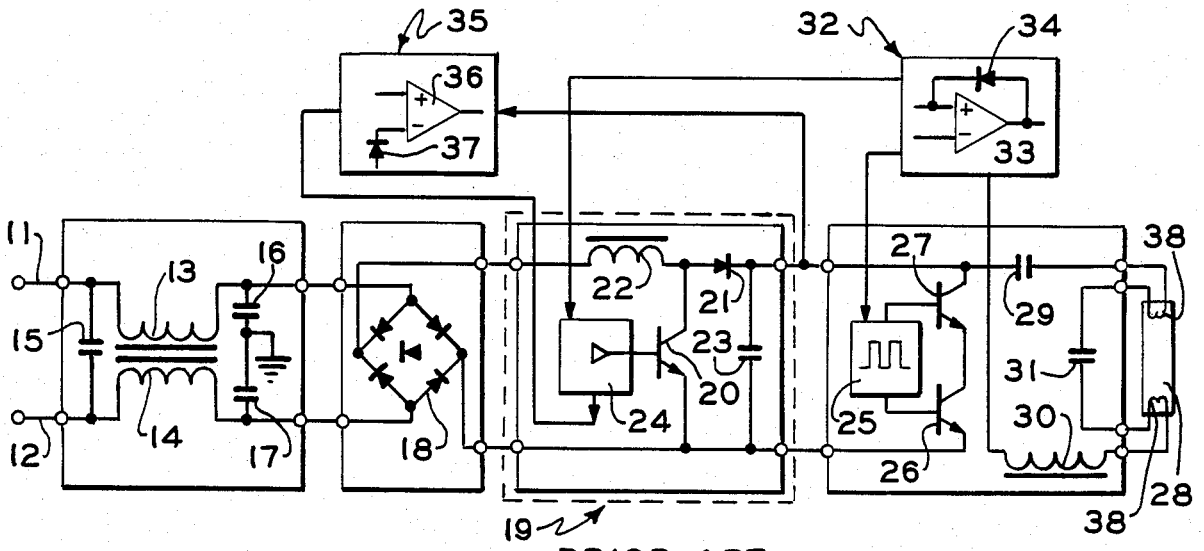
PRIOR ART FIG. 1
FIG. 1 is a schematic circuit diagram of a prior art electronic ballast utilizing a second converter stage.

FIG. 1 illustrates a prior art solid-state ballast designed to eliminate the harmonics and associated problems through the use of a second converter stage. The schematic circuit diagram of that figure includes line power supplied as at 11 and 12 which is subjected to a radio frequency interference filter system including induction or choke coils 13 and 14 together with capacitors 15, 16 and 17. The RFI filtered output is fed into a full wave rectifier 18 beyond which a second converter stage or "flyback type" switch-mode power supply stage enclosed by the dashed line at 19 is provided which includes a power transistor 20 and diode 21 together with a large inductor 22 and capacitor 23. The second converter stage is necessary to suppress the natural line voltage harmonics associated with the full wave bridge rectification. A lamp-control stage includes a source of pulse width modulated voltage 25 a push-pull, half-wave inverter system including transistors 26 and 27 which supplies power to one or more lamps 28 and an associated tuning filter network including capacitor 29 and inductor 30. Any voltage rise occasioned by an open circuit situation, as when a lamp is removed when the system is operating is prevented by capacitor 31. A lamp supervision system enclosed by dashed line 32 including comparator 33 and associated diode 34 is employed to provide dimming by modulation of the PWM voltage. This system also prevents an overvoltage or overcurrent situation from developing at the lamp 28. In addition, a voltage limiter circuit 35 is provided which includes comparator 36 and associated diode 37 to limit the voltage supplied to the inverter via amplification means 24.

In operation, the AC power supplied to lines 11 and 12 is rectified by the bridge 18 and supplied to the flyback type switch-mode power supply stage 19, which system is normally operated in the range of 30 to 60 KHz. The power supply stage chops up the rectified current at this frequency and thereby provides a chopped current pulse train of a value which is instantaneously linearly proportional to the main supply voltage. The energy pulses are continuously stored in inductor 22 when the transistor 20 is saturated and are subsequently continuously delivered to the storage capacitor 23 and diode 21 when the transistor 20 is switched off. This energy, then, is recoverable as DC voltage across the capacitor 23.

Preheating of the cathodes 38 or the ignition of the lamp is controlled by the lamp control stage which clearly resembles a free-running multivibrator with a push-pull output. Both power transistors 26 and 27 are driven as a function of the resonance current frequency determined by the tank circuit including inductor 30 and capacitor 31 such that a predetermined dead-time is assured between the turn-on periods of either of the transistors. During the ignition period of the lamp, an ignition voltage is provided which is damped by the cathode preheating process until the voltage reaches the level of ignition at which time the lamp will start. If the lamp is not ignited during the ignition time, or no lamp is connected, the protecting circuit 32 operates to shut down the ballast. Thus, at first turning on or at repeated turnings on, the preheat and start attempt periods will be repeated.

During normal operation the circuit oscillates at about 30 kHz and both the lamp voltage and the lamp current are approximately sinusoidal. The fluorescent lamps have the known characteristic that at both higher and lower than room ambient temperatures the virtual resistance of the lamps increases and, therefore, the power consumption changes. The voltage limiting circuit 35 is employed to limit the internal DC voltage increase which could otherwise rise dangerously. This voltage limit circuit controls the PWM setpoint of the drive circuit at 25 such that the rectified DC voltage will not exceed a prescribed limit.

Figure 2:
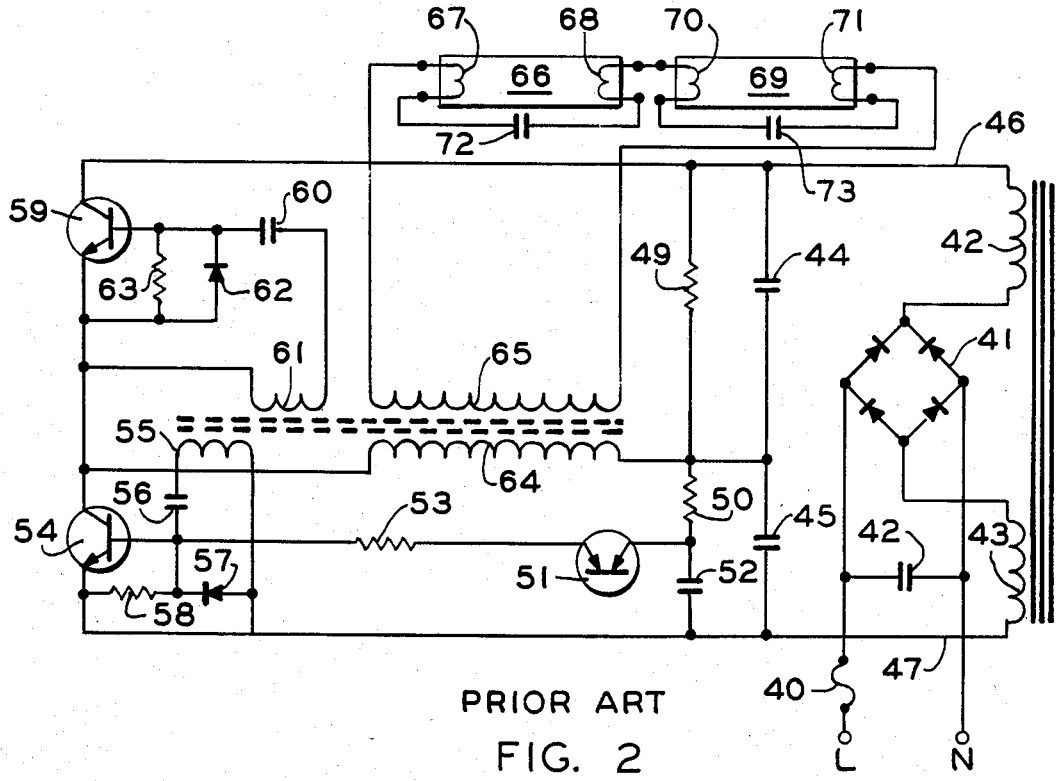
PRIOR ART FIG. 2
FIG. 2 is a schematic circuit diagram of a prior art electronic ballast using a rectifier bridge and an induction filtering system.

FIG. 2 depicts another embodiment of an electronic dimmable ballast in accordance with the prior art. The embodiment of FIG. 2 includes a typical controlled line AC input which may be varied in any well-known manner, e.g., by a phase controlled SCR/triac dimmer circuit in a well-known manner as is further described in the above-mentioned U.S. Pat. No. 4,392,087, Ser. No. 210,650. Such a dimming control circuit is a phase control circuit which controls the amount of current supplied to the controlled line terminal $L_1$ by varying the setting of a variable resistor. The controlled line AC input is provided with a fuselink or thermoresponsive switch as at 40. The input is connected to full wave bridge rectifier 41 which connects rectified alternate half waves with a rectifying filter system which includes filter inductors 42 and 43 and capacitors 44 and 45 connected across lines 46 and 47. Shunt resistors 49 and 50 are also provided. A further capacitor 48 is provided across the AC input lines to suppress RFI.

In order to accomplish suppression of line current harmonics below about 10 percent the inductors and capacitors must be quite large in capacity, e.g., 0.5H and about 30 mfd, respectively. RFI suppression alone on the other hand, may be accomplished by a capacitor as small as 0.1 mfd, or less. The filter circuit including the two inductors 42 and 43 and capacitors 44 and 45 is necessary to provide for the desired degree of suppression of harmonic distortion and to provide low ripple DC voltage to the inverter circuit.

A self-starting, half-bridge inverter system is provided including triggering element 51, which may be a silicon unilateral switch, diac or the like, a triggering capacitor 52, and resistor 53, the triggering element, discharges into the base of transistor 54. The base and emitter of transistor 54 are connected by a positive feedback loop including coil 55, capacitor 56, diode 57, and resistor 58. The second power transistor 59 is provided with a positive feedback circuit including capacitor 60, feedback coil 61, diode 62, and resistor 63. The primary transformer winding 64 is connected between the rectified input voltage and the juncture between the collector of transistor 54 and the emitter of transistor 59 such that the full sine wave current is provided to the single secondary winding 65. The secondary is used to power fluorescent lamp 66 having filament windings 67 and 68 and fluorescent lamp 69 having filament windings 70 and 71.

Capacitors 72 and 73 connected across the filaments of fluorescent lamps 66 and 69, respectively, are also provided. The capacitors 72 and 73 are utilized to provide tuned sinusoidal input to the lamps and provide substantially constant filament voltage input during dimming. The capacitors 72 and 73 are also used to control the voltage in the circuit when either lamp 66 or 69 is removed during the operation of the circuit such that none of the components will be subject to over voltage.

In that embodiment, secondary transformer winding 65 is located with respect to the primary winding 64 of the filament power transformer in a manner such that leakage inductance of the transformer is utilized to eliminate the need for any additional inductance in the secondary circuit. The system of FIG. 2 has been found to work especially well with low power lamp loads, i.e., less than about 40 watts, or at a relatively high AC input voltage, i.e., 220 volts or above as is common with European applications.

Figure 3:
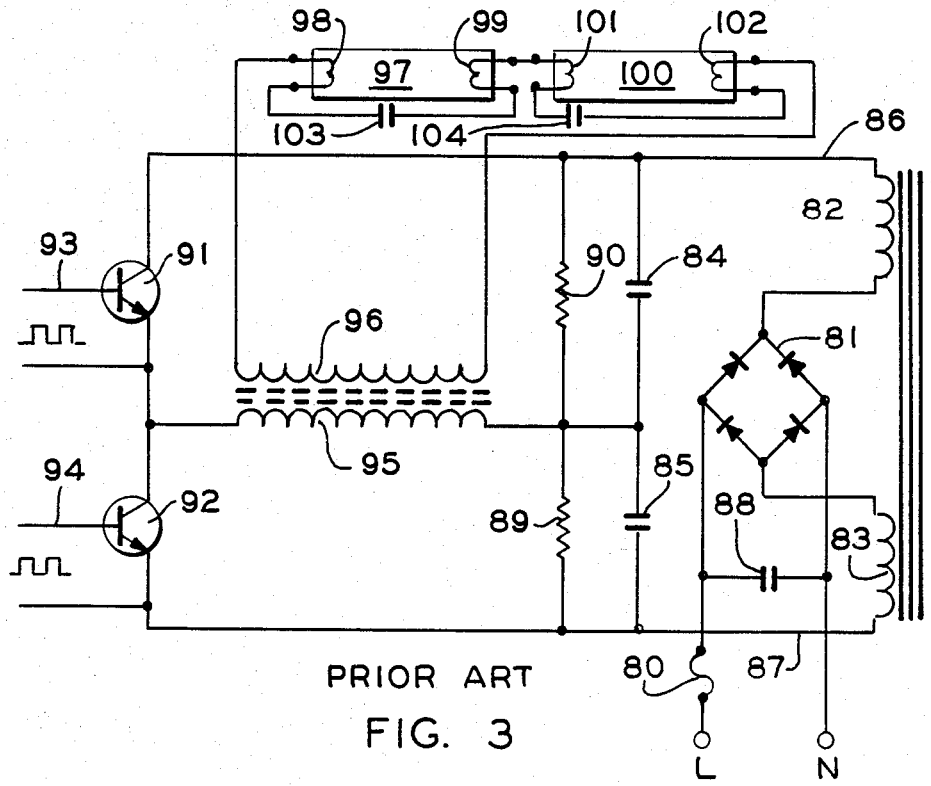
PRIOR ART FIG. 3
FIG. 3 is a schematic circuit diagram of the electronic ballast of FIG. 2 utilizing a pulsed width modulated drive.

Yet another prior art embodiment is illustrated by FIG. 3 in which a pulse width modulated (PWM) input replaces the self-oscillating circuit of the embodiment of FIG. 2 in supplying high frequency sinusoidal input to the transformer primary. The embodiment of FIG. 3 includes a typical controlled line AC input which may be identical with that of FIG. 2 with fuselink 80 connected to full wave bridge rectifier 81. Rectifier 81 connects rectified alternate half waves with the relatively large harmonic suppression filter inductors 82 and 83. As with the embodiment of FIG. 2, the harmonic suppression filter circuit further includes relatively large capacitors 84 and 85 connected across lines 86 and 87. Resistors 89 and 90 are also provided and a small capacitor 88, may be provided across the AC line to suppress RFI.

The self-oscillating system of FIG. 2 is replaced with a pulse width modulated input drive which includes a source of input PWM connected to the bases of transistors 91 and 92 at 93 and 94, respectively. Sources of such input are well known and can be supplied from known SMPS-IC circuits such as an SG 3525 manufactured by Silicon General Corporation of Garden Grove, Calif. The primary transformer winding 95 is connected between the rectified input voltage and the juncture between the collector of power transistor 92 and the emitter of power transistor 91, such that full sine input wave current is provided to the single secondary winding 96. The secondary, of course, is used to power fluorescent lamp 97 having filaments 98 and 99 and fluorescent lamp 100 having filaments 101 and 102. Capacitors 103 and 104 are provided and connected across the filaments of the fluorescent lamps 97 and 100, respectively, to provide tuned sinusoidal input to the lamps and also to provide substantially constant filament voltage during dimming.

As in the case of FIG. 2 the capacitors 103 and 104 are also used to control the voltage in the circuit when either lamp 97 or 100 is removed during operation of the circuit such that none of the components will be subject to over voltage. Also, the proximity of the secondary transformer winding 96 with respect to the primary winding 95 is such that leakage inductance of the transformer may be utilized to eliminate the need for any additional induction from the secondary circuit of the system.

It should be appreciated, however, with respect to each of the illustrated prior art embodiments that, while successful, all of them suffer from the same drawback. Namely, all these prior art ballasts require large, expensive filtering systems to reduce or eliminate distortion. As previously discussed, the distortion is principally made up of odd numbered harmonics of the rectified line frequency due to capacitor charging by the rectifier at each peak of the supply voltage and adversely affects the efficiency and life of the system.

Most Western European countries presently require by regulation that harmonic distortion be limited to 3 percent or less of the full voltage amplitude. While such a legal limitation does not presently exist in the United States or Canada, projected energy attitudes indicate that such regulation is most likely forthcoming. In Europe, this has made necessary such implementations as expensive electronic, harmonic power filter systems as exemplified by the inclusion of the second converter stage in the ballast embodiment of FIG. 1, large inductors 43 and 46 along with high value capacitors 44 and 45 in the embodiment of FIG. 2, and the large inductors 82 and 83 and high value capacitors 84 and 85 in the embodiment of FIG. 3. While such systems can be designed to successfully suppress the harmonics in the power supply to the degree necessary, and thereby also aid in achieving a power factor value close to unity, they add a great deal of additional cost to the solid-state dimming ballast and dissipate a relatively large amount of power which could otherwise be available for illumination.

Figure 4:
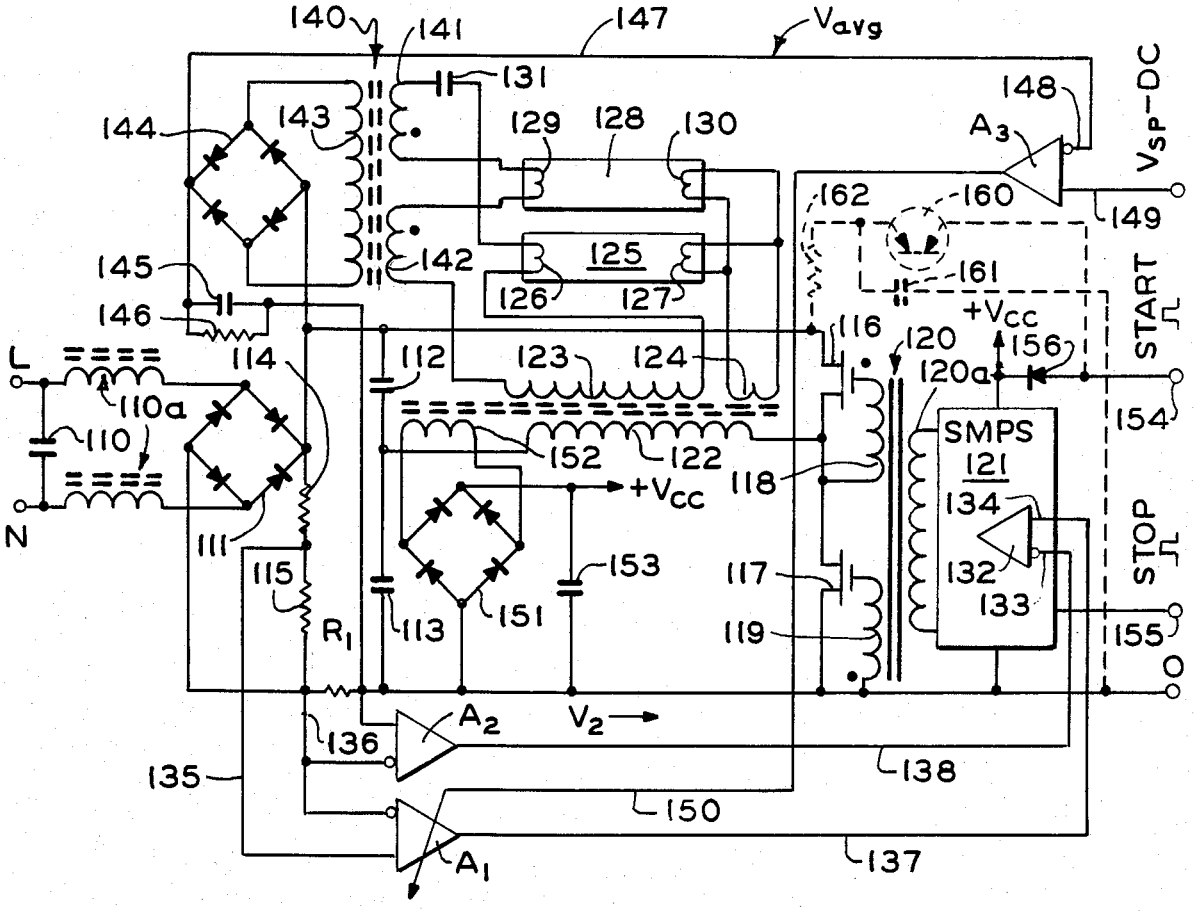
FIG. 4 is a schematic circuit diagram in accordance with the preferred embodiment of the present invention.

In accordance with the present invention the need for large, expensive and high power loss LC filters or second converter stages for interference suppression systems is eliminated by the provision of a sinusoidal main supply current synthesizing concept utilizing feedback control which reduces the cost of the ballast at no sacrifice in performance. One embodiment of the present invention is illustrated in FIG. 4.

In that embodiment the main AC power supply is fed through a small RFI suppression choke at **110*a* with small (0.1 mfd) capacitor 110 with no appreciable 60 Hz voltage drop or power loss. The system further includes a rectifier bridge 111 and two small (approximately 1.0 mfd) filter capacitors 112 and 113. The capacitors characteristically act as a shunt with respect to all the high frequency components, e.g., above 10 kHz without having any appreciable filtering effect on the 120 hz pulse frequency of the full wave rectified 60 Hz power input. Voltage dividing resistors 114 and 115** are also included.

A half-bridge inverter is provided including switching transistors 116 and 117 which may be power MOSFETS or other such known semiconductor switches as would occur to one skilled in the art. The MOSFETS are driven with high frequency pulse width modulated voltage via secondary windings 118 and 119 of transformer 120. It should be noted that with MOSFETS there are internal recess connected rectifiers (not shown). However, with other types of semiconductor switches (transistors, GTO's, etc.) external diodes should be used connected in parallel, in reverse directions. Pulse width modulated voltage is supplied to the primary winding 120*a* in a well-known manner as from a switch mode power supply (SMPS) integrated circuit 121 which may be, for example, a Silicon General SG3525. The form of the output of the inverter simulates a full sinewave.

The primary winding 122 of the main ballast transformer is connected between the rectified, RFI filtered input voltage of the juncture of capacitors 112 and 113 and the juncture between the source of FET 116 and the drain of FET 117 such that the full sinewave current is provided through the main secondary winding 123 and auxiliary secondary windings 124 and 152. The secondaries 123 and 124 are used to power fluorescent tube 125 having filament 126 and 127 and fluorescent tubes 128 having filament 129 and 130. The auxiliary secondary winding 124 is connected across filaments 127 and 130 of the respective tubes 125 and 128. The distances between the primary transformer winding 122, main secondary winding 123 and auxiliary secondary winding 124 are made such that the leakage inductance of the transformer is utilized to maintain an essentially constant voltage at the lamp elements despite changes in the primary winding input voltage which are employed to produce modulation of the brightness of the lamps. A further tuning capacitor 131 is provided which also protects circuit components from over voltage due to removal of one or both of the tubes 125 or 128 during operation of the system.

The harmonic suppression system of the invention makes use of SMPS in conjunction with a feedback system utilizing an error signal based on dual input signals which are functions of the voltage and current input monitoring amplifiers.

The operation of the SMPS integrated circuit 121 is well known to those skilled in the art. It contains an operational amplifier depicted at 132 characteristically having one inverting input 133 and one non-inverting input 134. These inputs are connected to two continuous signals. The inverting signal is provided through a variable gain operational amplifier-multiplier $A_1$ which signal is linearly proportional to the full-wave rectified but unfiltered main supply voltage from the output of the full wave bridge 111 via conductors 135 and 136. This signal on conductor 137 may be denoted as $K_1V_1A_1$ where $K_1$ is a constant, $V_1$ is the momentary value of the main supply voltage and $A_1$ is the value of the variable gain of the operational amplifier-multiplier $A_1$ at that instant. The other signal is a voltage signal which is linearly proportional to the input line current through the resistor $R_1$ as amplified by the operational amplifier $A_2$. In this manner the output $V_2$ of amplifier $A_2$ equals a $V_2=i_1R_1A_2$ where i is the current through the resistor $R_1$ and $A_2$ is the gain of the operational-amplifier $A_2$. This signal is conducted on line 138 to the input 133.

These two signals are compared to each other by the operational amplifier 132 of the SMPS IC 121, which also controls the pulse width of the PWM voltage supplied to the transformer 120 and, in turn, to the half-bridge inverter. Thus, when the current of the input line is not coincident in phase and/or amplitude, i.e., in the same shape as the input main supply voltage which has been full-wave rectified, there will be an error voltage signal at the input of the amplifier 132. This error signal will cause the SMPS to immediately, instantaneously modulate the pulse width of the input to the transformer 120 to correct the inverter output so that the current is drawn from the main supply which is monitored by $A_1$ through $R_1$ will immediately change shape to match the monitored, full-wave rectified voltage through resistor 115.

In this manner the output of the inverter is closely controlled so that abberations in the power supply such as those caused by the presence of harmonics may be substantially eliminated. Of course, because the system forces the current and voltage forms to be in phase at all times, the system achieves, on the average, a unity power factor.

Controlled dimming of the fluorescent tubes 125 and 128 may be accomplished in any compatible manner. One system is illustrated in FIG. 4. The average value of the fluorescent lamp current is sensed via a sensing circuit including a current transformer 140 having dual primary windings 141 and 142 and secondary winding 143, a full wave rectifier 144, capacitor 145 and resistor 146. It will be appreciated that the average lamp current is proportional to the average DC voltage ($V_{avg}$) on line 147 and, therefore, is also proportional to the average light output of the fluorescent lamps. This $V_{avg}$ signal is fed via conductor 147 as an input to the inverting input 148 of an operational amplifier $A_3$ at 148 where it is compared with an externally controlled DC voltage setpoint control input 149 which may be directly or remotely controlled. If and when the lamp current proportional DC voltage $V_{avg}$ differs from the setpoint voltage level, the amplifier $A_3$ amplifies the voltage level difference or error signal and then immediately and proportionately alters the gain of the operational amplifier-multiplier $A_1$ via a gain control line 150 so that the average value of the pulse width modulated output power from the inverter to the fluorescent lamps, and thus the output light level, will change to match the desired setpoint. In this manner via the SMPS IC, the sensed voltage error between the setpoint at 149 and $V_{avg}$ on line 147 is eliminated and the lamp output controlled at the desired level.

Other DC voltage $V_{cc}$ as is needed by the system may be supplied as by full wave rectifier 151 in conjunction with secondary coil 152 and filter capacitor 153 in a "bootstrap" manner. Start and stop input devices are illustrated at 154 and 155.

In one adaptation of the ballasts of the invention, it may be externally started as by a building automation system. In this manner a START signal is received at 155 which may consist of a DC voltage, generated by a manual, automatic, or remote control system manner is applied momentarily through diode 156 to the $V_{cc}$ input of the SMPS IC. This provides a momentary power supply for the SMPS IC 121 which starts operating in its normal mode. This also allows a rectified DC voltage to be available at the $V_{cc}$ output of the rectifier 151 which will continue to supply DC power to the control SMPS IC in a "bootstrap" manner once the system is functioning. Similarly, if the solid-state ballast is to be turned off or put into a "stopped" operating mode, the appearance of a "STOP" signal at 155 will stop the oscillation by applying a momentary voltage at the shutdown input of the IC. This signal will shut the inverter down according to the operation of the SMPS IC in a well-known manner.

The use of the start and stop input signals and the variable dimming control signal 149 enables the system of the solid-state ballast of the invention to be remotely addressed by any system using such signals such as a power line carrier addressing system, computer, or the like for use in numerous applications. Such a system is shown in the copending application to Stamm, et al, Ser. No. 448,538, cross-referenced above.

An alternative to the remote control system for starting the ballast of the present invention is depicted in phantom in FIG. 4. This consists of a self-starting system including a triggering element such as a silicon unilateral switch or the like 160 connected between a triggering capacitor 161 and resistor 162. This system operates in a well-known manner and is similar to that of FIG. 2. This may be in response to stop and start pushsbuttons or the like which could replace inputs 155 and 157.

The embodiments of the invention in which an exclusive property or right is claimed are defined as follows:

1. A two-wire electronic dimming ballast arrangement for one or more gas discharge lamps comprising:

a source of variable pulse width square wave electric power;

a source of full-wave rectified AC;

single inverter means adapted to be driven by said variable pulse width electric power;

first transformer means for supplying electric power of substantially constant voltage to the heating filaments of said one or more gas discharge lamps connected to the output of said inverter means;

control means for modulating the pulse width of said variable pulse width square wave electric power driving said inverter means;

distortion suppression means for suppressing current abberations and achieving substantially a unity power factor associated with said control means, said distortion suppression means further comprising:

first signal generating means for generating a continuous signal indicative of the instantaneous value of the voltage of said full-wave rectified AC, second signal generating means for generating a continuous signal indicative of the instantaneous value of the current of said full-wave rectified AC, comparator means in said control means having first and second inputs connected to the outputs of said first and second signal generating means, respectively, said comparator means generating an error signal output therefrom indicative of any phase or shape difference between said rectified voltage and said rectified current and wherein any error signal output from said comparator induces said control means to modulate the pulse width of said variable pulse width electric power driving said inverter in a manner such that the drawn current changes shape to match said voltage; and dimming means associated with said first signal generating means for modulating the output of said one or more gas discharge lamps by modulating the output of said first signal generating means.

2. The apparatus according to claim 1 wherein said control means includes a switch mode power supply control integrated circuit.

3. The apparatus according to claim 2 wherein said inverter further comprises a pair of power semiconductor switches.

4. The apparatus according to claim 3 wherein said semiconductor switches are MOSFETS.

5. The apparatus according to claim 1 wherein said control means further comprises second transformer means connected between the output of said source of variable square wave electric power, and the input of said inverter means.

6. The apparatus according to claim 1 wherein both said first and second signal generating means are operational amplifiers and wherein the input thereto are derived from the unfiltered output of said source of full-wave restified AC.

7. The apparatus according to claim 1 wherein said first signal generating means is a variable gain amplifier and wherein said dimming means includes means for modulating the gain of said variable gain amplifier.

8. The apparatus according to claim 1 wherein said inverter means is not self oscillating and wherein said ballast further comprises an additional internal source of full wave rectified AC to supply DC to operate said control means.

9. The apparatus according to claim 8 wherein said DC is derived from an auxiliary secondary winding associated with said first transformer means.

10. The apparatus according to claim 8 wherein said control means includes an integrated circuit means to control said modulation of said pulse width and wherein said ballast is started by an externally delivered timed pulse of DC to the DC operating input of said integrated circuit means with said additional internal source.

11. The apparatus according to claim 10 wherein said ballast is turned off by an externally delivered timed pulse of DC to the shutdown input of said integrated circuit means.

12. The apparatus according to claim 1 wherein said control means includes an integrated circuit means for modulating said pulse width, said integrated circuit means including oscillation means which is self oscillating.

13. The apparatus according to claim 12 wherein the self-oscillation associated with said integrated circuit comprises a triggering element for initially producing an input of DC to the DC operating input of said integrated circuit to begin operation.

* * * * *